US007485823B2

(12) United States Patent
Casey et al.

(10) Patent No.: US 7,485,823 B2
(45) Date of Patent: Feb. 3, 2009

(54) METHODS AND APPARATUS FOR CONSTRUCTING A MULTI-PART SWITCH

(75) Inventors: Kevin Franklin Casey, Cary, NC (US); Mark Cameron Cassada, Hillsborough, NC (US); Frederic Michael Kozak, Raleigh, NC (US); Kevin Craig Redmon, Durham, NC (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 11/733,867

(22) Filed: Apr. 11, 2007

(65) Prior Publication Data

US 2008/0251367 A1 Oct. 16, 2008

(51) Int. Cl.
*H01H 3/12* (2006.01)

(52) U.S. Cl. ..... 200/341

(58) Field of Classification Search ..... 200/292, 200/341, 16 R, 16 C, 16 D, 5 R, 11 R, 246, 200/11 DA, 11 TW, 16 A; 361/781; 439/188
See application file for complete search history.

(56) References Cited

U.S. PATENT DOCUMENTS 3,900,709 A * 8/1975 Sheesley et al. ..... 200/246
3,999,021 A * 12/1976 Delp ..... 200/292
4,326,110 A * 4/1982 Zdanys, Jr. ..... 200/291
4,728,164 A 3/1988 Lemmens et al.
5,552,964 A * 9/1996 Naito ..... 200/243
6,781,071 B2 8/2004 Leng et al.
6,984,796 B2 1/2006 Blossfeld
7,030,325 B2 4/2006 Blossfeld et al.
2004/0154907 A1 8/2004 Blossfeld et al.

* cited by examiner

*Primary Examiner*—Edwin A. Leon
(74) *Attorney, Agent, or Firm*—Peggy A. Su

(57) ABSTRACT

Methods and apparatus for providing a switch that includes multiple parts, and is arranged to function after extended periods of being in a depressed state are disclosed. In one embodiment, a multi-part switch includes a first contact, a second contact, and a plate. The first contact is electrically coupled to a first lead on a circuit board, and a second contact is electrically coupled to a second lead on the circuit board. The plate includes an electrically conductive area that contacts the first contact and the second contact to allow a signal to flow from the first contact to the second contact through the plate. In contacting the first contact and the second contact, the plate applies a compressive force to the first contact and to the second contact.

5 Claims, 5 Drawing Sheets

METHODS AND APPARATUS FOR CONSTRUCTING A MULTI-PART SWITCH

BACKGROUND OF THE INVENTION

Switches are typically utilized for a wide variety of purposes on circuit boards or, more specifically, printed circuit boards. In general, relatively small switches which are intended to be used in small spaces are not arranged to sustain a depressed, or engaged, state for an extended period of time. That is, most very small switches that take up relatively little space on circuit boards are limited in use to momentary action, or action which does not involve a switch being in a depressed configuration for relatively long period of time.

A typical small switch includes a spring that is compressed when the switch is engaged. When such a switch is engaged for an extended period of time and then released, the spring effectively weakens and may be permanently deformed such that the switch may no longer perform. In other words, engaging a relatively small switch for a relatively long time may apply stresses that may cause a spring included in the switch to weaken such that it no longer returns to a nominal, uncompressed state, and such that the height of the spring in an uncompressed state is substantially reduced. As a result, the performance of the switch may significantly degrade over a relatively short period of time.

BRIEF DESCRIPTION OF THE DRAWINGS

The invention may best be understood by reference to the following description taken in conjunction with the accompanying drawings in which.

DESCRIPTION OF EXAMPLE EMBODIMENTS

General Overview

In one embodiment, a multi-part switch includes a first contact, a second contact, and a plate. The first contact is electrically coupled to a first lead on a circuit board, and a second contact is electrically coupled to a second lead on the circuit board. The plate includes an electrically conductive area that contacts the first contact and the second contact to allow a signal to flow from the first contact to the second contact through the plate. In contacting the first contact and the second contact, the plate applies a compressive force to the first contact and to the second contact.

DESCRIPTION

A multi-part switch that allows contacts to be deflected by cover with a conductive surface when the multi-part switch is in a compressed or engaged state may be used in relatively confined spaces. The contacts may be positioned substantially anywhere on a circuit board, and the cover with the conductive surface may be positioned over the circuit board such that the conductive surface may electrically couple the contacts. A switch connection of the multi-part switch is essentially closed, e.g., depressed, when the conductive surface applies a compressive or deflective force to the contacts. The switch connection may be opened when the compressive or deflective force is removed, i.e., when the cover with the conductive surface is removed.

In one embodiment, contacts that are used in multi-part switches may include a cantilever or beam portion. By substantially incorporating a cantilever portion into a contact, and forming the contact from a material with relatively high yield strength properties, a multi-part switch that includes the contact may effectively be engaged without significantly stressing, or deforming, the contact. As such, the multi-part switch may still perform as expected even after being continually depressed for relatively long periods of time.

Figure 1:
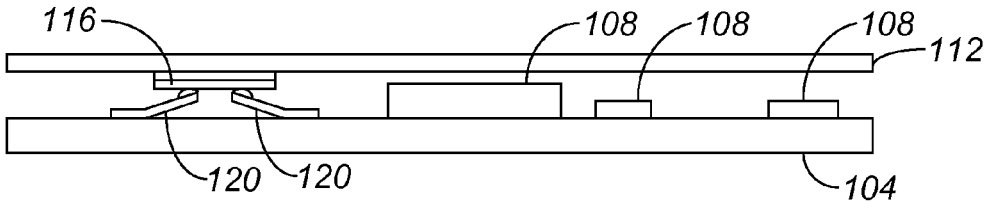
FIG. 1 is a diagrammatic side view representation of an assembly that includes a multi-part switch arrangement which is engaged in accordance with an embodiment of the present invention.

Referring initially to FIG. 1, a multi-part switch arrangement will be described in accordance with an embodiment of the present invention. A multi-part switch arrangement is generally formed from components that are physically separate when the multi-part switch arrangement is not engaged. Contacts 120, a cover 112, and a conductive plate or surface 116 are components of a multi-part switch arrangement. Contacts 120 are mounted on or otherwise provided on a circuit board 104, e.g., a printed circuit board, such that each contact 120 may be communicably coupled to leads or traces (not shown) on circuit board 104. As will be appreciated by those skilled in the art, contact 120 may be a surface mount component arranged to be communicably coupled to leads or traces (not shown) through being soldered to pads (not shown) on circuit board 104.

Conductive surface 116, which is supported on cover 112, effectively applies a compressive force on contacts 120 that causes cantilevered portions to deflect. Hence, the multi-part switch arrangement is engaged or depressed such that a signal, as for example an electrical signal, may flow from one contact 120 to the other contact 120 using conductive surface 116 as a conduit. When a compressive force is applied on contacts 120, contacts 120 and conductive surface 116 maintain contact such that the multi-part switch arrangement sustains an engaged or depressed state. It should be appreciated, however, the an electrical signal may flow between contacts 120 through conductive surface 116 as long as the circuit is closed, i.e., as long as there is contact between contacts 120 and conductive surface 116 even if contacts 120 are not deflected.

While conductive surface 116 has been described as being supported on cover 112, conductive surface 116 may instead be integrated into cover 112. In general, conductive surface 116 may be formed from substantially any material that effectively prevents a galvanic cell from being formed between conductive surface 116 and contacts 120 or, more specifically, between the material from which conductive surface 116 is formed and the material from which contacts 120 are formed. Typically, the material from which conductive surface 116 is formed is selected based upon the material from which contacts 120 are formed.

The amount of force needed to effectively and affirmatively engage a multi-part switch is substantially provided by deflecting contacts 120, although it should be understood that a multi-part switch may also be engaged without deflecting contacts 120. However, affirmatively engaging a multi-part switch by deflecting contacts 120 allows the multi-part switch to be robust and relatively resistant to mechanical vibration and shock. That is, engaging the multi-part switch such that there is some contact force between contacts 120 and conductive surface 116, and some deflection of contacts 120, effectively ensures that contacts 120 and conductive surface 116 will maintain contact in the event of mechanical vibration or shock.

As will be appreciated by those skilled in the art, each contact 120 has a spring rate which is a function of the modulus of elasticity of the material from which contacts 120 are formed, as well as the dimensions of contacts 120. Although the materials from which contacts 120 are formed may vary widely, the materials typically include, but are not limited to including, materials that are relatively resistant to plastic deformation such as beryllium copper and spring steel, conductive polymers that are bonded to circuit board 104, conductively filled or plated polymers, and conductively plated or filled composites such as carbon fiber or carbon/Kevlar®. The dimensions of contacts 120 may also vary widely, and may be dependent at least in part upon the size of circuit board 104 and the height of components 108.

Circuit board 104 generally supports components 108, which may include surface mounted electrical components. Cover 112, as shown, is arranged to effectively cover components 108, and may span the length and the width of circuit board 104. While cover 112 covers components 108, cover generally does not contact components 108. In one embodiment, however, nonconductive areas of cover 112 may come into contact with components 108.

Figure 2:
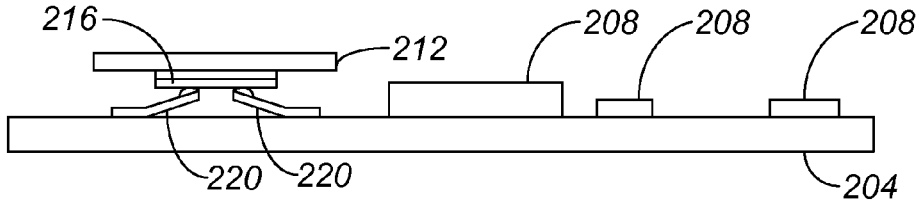
FIG. 2 is a diagrammatic side view representation of an assembly that includes an engaged multi-part switch arrangement in which a cover is arranged to overlay substantially only switch contacts in accordance with an embodiment of the present invention.

It should be appreciated that a cover may instead be arranged to cover substantially only contacts associated with a multi-part switch arrangement. FIG. 2 is a diagrammatic side view representation of an assembly that includes an engaged multi-part switch arrangement in which a cover is arranged to overlay substantially only contacts of the multi-part switch arrangement in accordance with an embodiment of the present invention. A multi-part switch arrangement includes a cover 212, a conductive plate or surface 216 associated with cover 212, and a plurality of contacts 220. When the multi-part switch arrangement is effectively depressed, as shown, conductive surface 216 applies a compressive force to contacts 220. Contacts 220 are mounted on a circuit board 204, along with components 208. As shown, cover 212 is effectively arranged to cover contacts 220, and not any components 208.

If a cover is arranged to cover more than one set of contacts, i.e., more than just the contacts associated with one multi-part switch, the cover may include a single conductive plate that contacts each multi-part switch that is associated with the cover. However, a cover may instead include a separate conductive plate or surface for each multi-part switch that is associated with the cover. Alternatively, the cover may include a single surface that includes a plurality of conductive areas. A cover that includes separate conductive surfaces will be discussed with respect to FIG. 3A, while a cover that includes a single surface with a plurality of conductive areas will be discussed with respect to FIG. 3B.

Figure 3A:
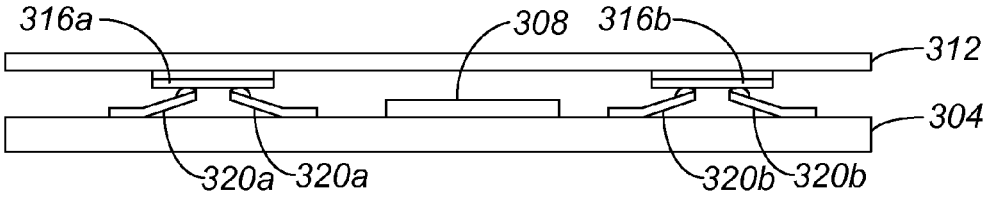
FIG. 3A is a diagrammatic side view representation of an assembly that includes engaged multi-part switch arrangements in which a shared cover with a plurality of conductive plates is associated with a plurality of multi-part switch arrangements in accordance with an embodiment of the present invention.

FIG. 3A is a diagrammatic representation of an assembly that includes a plurality of multi-part switches which share a cover that supports separate conductive plates or surfaces in accordance with an embodiment of the present invention. A circuit board 304 supports a component 308, contacts 320*a* associated with a first multi-part switch, and contacts 320*b* associated with a second multi-part switch. A cover 312 includes a first conductive plate or surface 316*a* and a second conductive plate or surface 316*b*. First conductive surface 316*a* is arranged to contact contacts 320*a* when a multi-part switch that includes conductive surface 316*a* and contacts 320*a* is depressed or otherwise "on." Second conductive surface 316*b* is arranged to contact contacts 320*b* when a multi-part switch that includes conductive surface 316*b* and contacts 320*b* is depressed or otherwise "on."

Figure 3B:
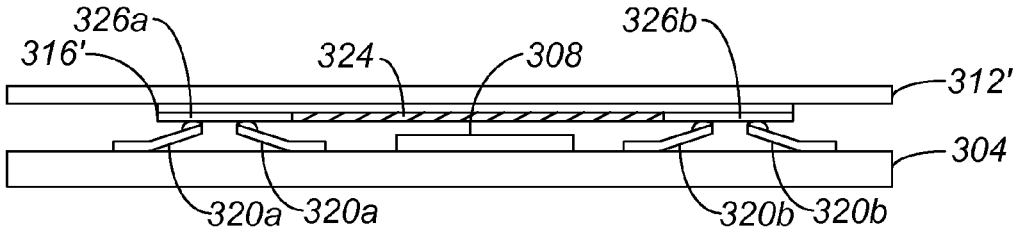
FIG. 3B is a diagrammatic side view representation of an assembly that includes engaged multi-part switch arrangements in which a shared cover with a single plate is associated with a plurality of multi-part switch arrangements in accordance with an embodiment of the present invention.

In lieu of being covered by cover 312, circuit board 304 may instead be covered by a cover that is associated with a single surface which has conductive areas. FIG. 3B is a diagrammatic representation of an assembly that includes a plurality of multi-part switches which share a cover that includes a single surface with conductive areas in accordance with an embodiment of the present invention. A cover 312' includes a plate or surface 316' that includes conductive areas 326*a*, 326*b*. Surface 316' also includes a non-conductive area 324. Conductive area 326*a* is arranged to contact contacts 320*a* when a multi-part switch associated with contacts 320*a* is closed or engaged, and conductive area 326*b* is arranged to contact contacts 320*b* when a multi-part switch associated with contacts 320*b* is closed or engaged.

Figure 4:
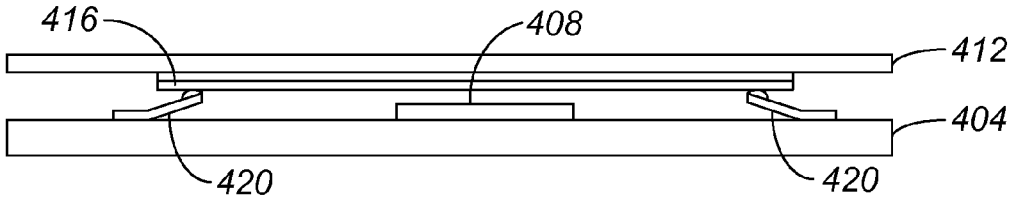
FIG. 4 is a diagrammatic side view representation of an assembly that includes a multi-part switch arrangement with spaced apart contacts in accordance with an embodiment of the present invention.

In general, a multi-part switch that includes contacts mounted on a circuit board are arranged to occupy a relatively small footprint on the circuit board. That is, the contacts of a multi-part switch may be spaced apart by a relatively small amount that is sufficient to effectively ensure that accidental contact between the contacts does not occur, e.g., during a manufacturing process. If contacts are associated with a relatively high current interconnection, the spacing between the contacts may be such that applicable safety standards are not violated. It should be appreciated that contacts may be spaced relatively far apart, as for example when routing and/or spacing constraints associated with the circuit board do not allow for the contacts to be placed in close proximity with each other. With reference to FIG. 4, a multi-part switch arrangement which includes contacts that are spaced relatively far apart will be described in accordance with an embodiment of the present invention. A circuit board 404 includes contacts 420 that are part of a multi-part switch arrangement. Contacts 420 are spaced relatively far apart such that, as shown, at least one component 408 may be located between contacts 420. A cover 412 is arranged to effectively overlay circuit board 404, and to support a conductive plate or surface 416 that is arranged to cause contacts 420 to deflect such that the multi-part switch arrangement is engaged or depressed. Conductive surface 416, when in contact with contacts 420, enables signals to pass from one contact 420 to the other contact 420 through conductive surface 416.

Figure 5:
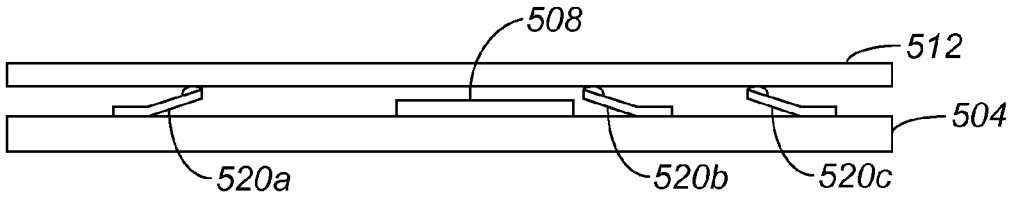
FIG. 5 is a diagrammatic representation of an assembly that includes a multi-part switch arrangement with a plurality of contacts that are engaged with a grounded cover in accordance with an embodiment of the present invention.

A cover may be used, in one embodiment, to ground a single contact that is mounted on a circuit board. That is, a cover that is coupled to a ground, e.g., a grounded chassis, may be used to ground a circuit that includes a single contact and is printed on a circuit board. Referring next to FIG. 5, a circuit board which includes a plurality of individual, substantially unpaired contacts that are arranged to be grounded by a cover will be described in accordance with an embodiment of the present invention. Individual contacts 520*a-c* are mounted on a circuit board 504 which also includes at least one component 508. In the described embodiment, contacts 520*a-c* are each arranged to ground an associated circuit (not shown) that is laid out on circuit board 504. A cover 512 is associated with a ground. That is, cover 512 is grounded. Hence, when cover 512 applies a compressive force on contacts 520*a-c* and causes contacts 520*a-c* to deflect, contacts 520*a-c* each effectively become grounded. As such, the circuits (not shown) coupled to contacts 520*a-c* are grounded while cover 512 applies a compressive or deflecting force on contacts 520*a-c,* e.g., when multi-part switches associated with contacts 520*a-c* are depressed or otherwise engaged.

Figure 6A:
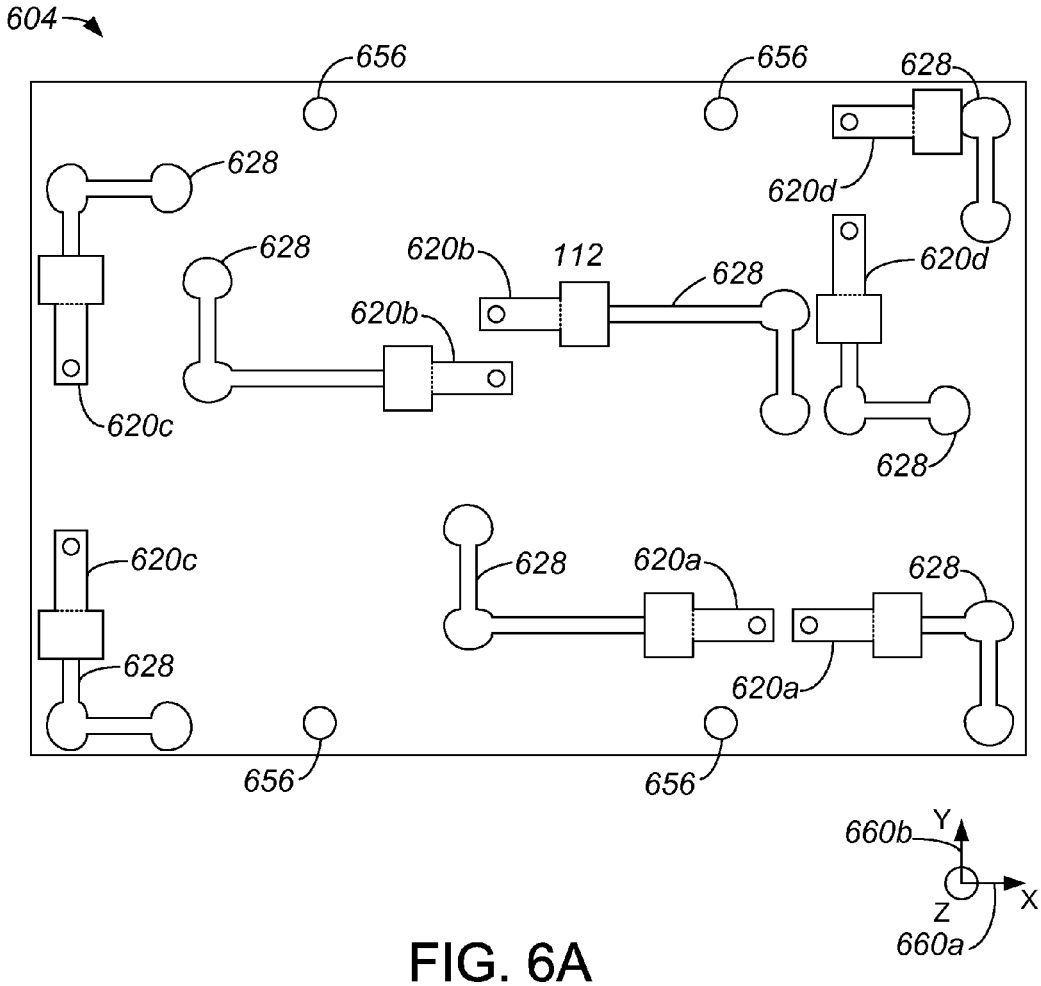
FIG. 6A is a diagrammatic top-view representation of a circuit board on which contacts of multi-part switch arrangements are mounted in accordance with an embodiment of the present invention.
Figure 6B:
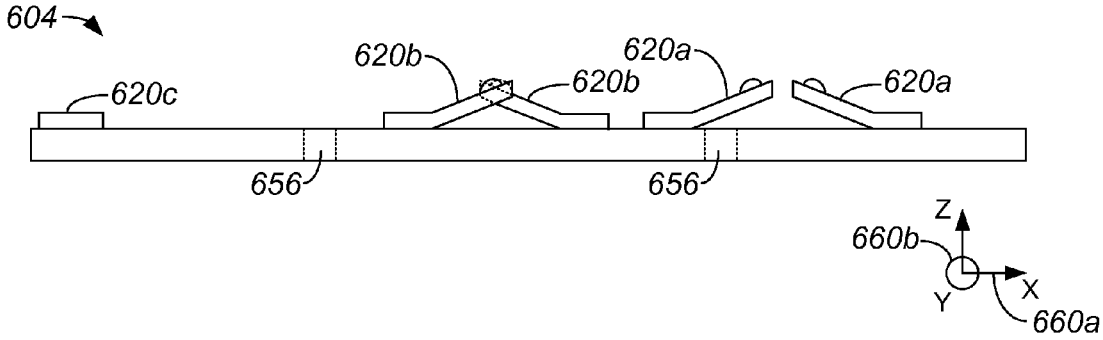
FIG. 6B is a diagrammatic side-view representation of a circuit board, i.e., circuit board 604 of FIG. 6A, on which contacts of multi-part switch arrangements are mounted in accordance with an embodiment of the present invention.

As previously mentioned, a circuit board may support a plurality of multi-part switch arrangements. FIG. 6A is a diagrammatic top-view representation of a circuit board on which contacts of multi-part switch arrangements are mounted in accordance with an embodiment of the present invention. FIG. 6B is a diagrammatic side-view representation of circuit board 604 of FIG. 6A in accordance with an embodiment of the present invention. A circuit board 604 includes a plurality of pairs of contacts 620*a-d* that are parts of multi-switch arrangements. Each contact of the pairs of contacts 620*a-d* are coupled to leads or traces which are printed or otherwise embodied on circuit board 604. For ease of illustration, various components, as for example electrical components, which may generally be included on circuit board 604 are not shown.

The orientation of each contact of a pair of contacts 620*a-d* relative to its associated contact may vary. As shown, contacts 620*a* are spaced relatively close to each other such that the tips of contacts 620*a* are substantially aligned in an opposing manner along an x-axis 660*a*. Contacts 620*b,* while spaced relatively close to each other, are substantially aligned such that ends of contacts 620*b* are aligned relative to a y-axis 660*b*. Contacts 620*c* are also substantially aligned relative to y-axis 550*b,* but in an opposing manner. In addition, contacts 620*c* are spaced relatively far apart from each other. Contacts 620*d* are arranged such that although the ends of contacts 620*d* are substantially aligned relative to y-axis 660*b,* contacts 620*d* are aligned perpendicularly relative to one another. It should be appreciated that the orientation of pairs of contacts 620*a-d* may vary widely, and are not limited to the orientations shown in FIGS. 6A and 6B.

In general, a compressive or deflection force may be generated on pairs of contacts 620*a-d* by a cover arrangement (not shown) which, together with each of the pairs of contacts 620*a-d,* forms multi-part switch arrangements. To generate and to maintain a compressive force while the switch arrangements are depressed or otherwise engaged, the cover arrangement (not shown) may be secured against circuit board 604. The methods and mechanisms used to removably secure a cover arrangement (not shown) to circuit board 604 may include, but are not limited to including, holding the cover arrangement in a slot in a chassis that also holds circuit board 604 such that the cover arrangement causes contacts 620*a-d* to deflect and physically coupling the cover arrangement to circuit board 604. In one embodiment, screws or similar fasteners may be used to screw a cover arrangement (not shown) into or through circuit board 604 such that the cover arrangement causes contacts 620*a-d* to deflect. Openings 656 may be used to receive screws or other fasteners that allow a cover arrangement (not shown) to be secured against contacts 620*a-d*. It should be appreciated that because a cover arrangement (not shown) may include any number of separate covers, the number and location of openings 656 may vary.

Figure 7A:
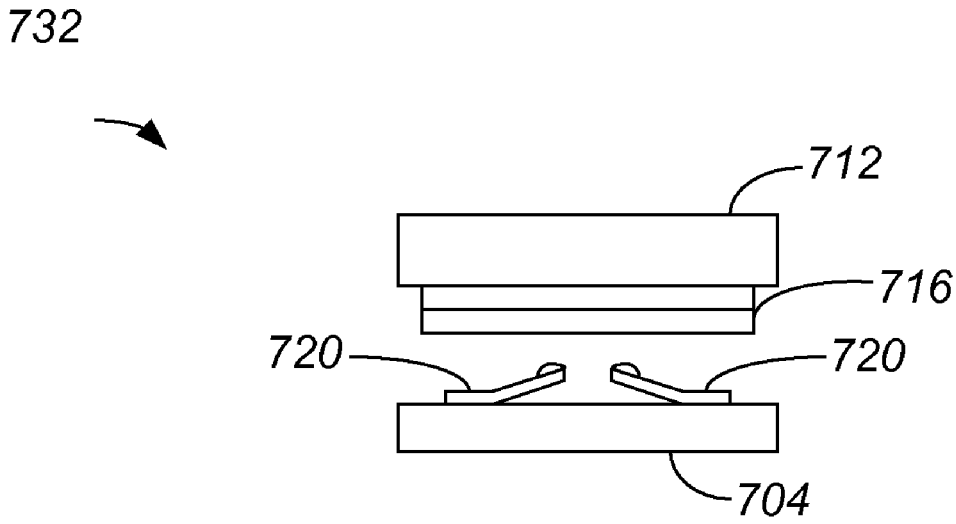
FIG. 7A is a diagrammatic side-view representation of a multi-part switch in an unengaged state in accordance with an embodiment of the present invention.

Typically, when a multi-part switch arrangement is in a disengaged state, there is no physical contact between contacts mounted on a circuit board and a conductive surface supported on a cover. FIG. 7A is a diagrammatic side-view representation of a multi-part switch arrangement in a disengaged or non-depressed state in accordance with an embodiment of the present invention. A multi-part switch arrangement 732 includes a pair of contacts 720, a cover 712, and a conductive surface 716 that may be mounted on or incorporated into cover 712. In general, contacts 720 are mounted on a circuit board 704. When conductive surface 716 is not in contact with contacts 720 or, more specifically, when conductive surface 716 does not contact contacts 720 such that contacts 720 deflect, multi-part switch arrangement 732 is not engaged. When multi-part switch arrangement 732 is not engaged, contacts 720 are in an uncompressed or undeflected state.

Figure 7B:
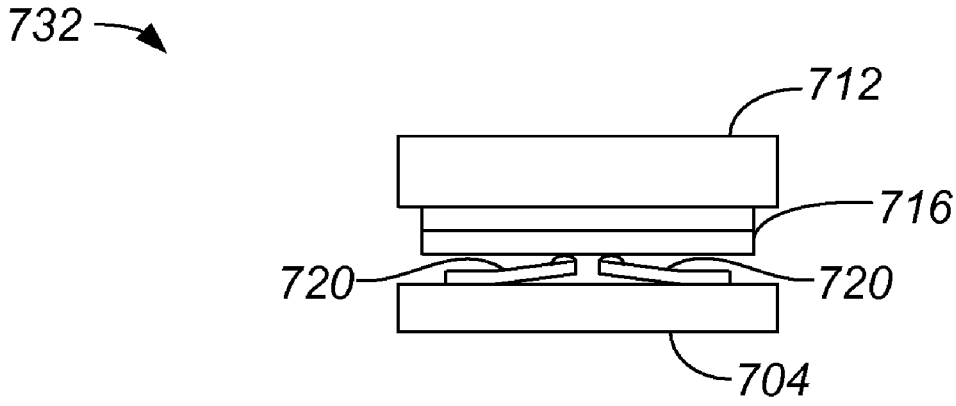
FIG. 7B is a diagrammatic side-view representation of a multi-part switch, i.e., multi-part switch 732 of FIG. 7A, in a depressed state in accordance with an embodiment of the present invention.

FIG. 7B is a diagrammatic side-view representation of multi-part switch arrangement 732 in an engaged or depressed state in accordance with an embodiment of the present invention. When multi-part switch arrangement 732 is in an engaged state, conductive surface 716 is in contact with contacts 720 such that contacts 720 deflect. That is, cover 712 applies a compressive or deflection force on contacts 720 through conductive surface 716 such that multi-part switch arrangement 732 is essentially depressed. Hence, a signal may flow from one contact 720 to the other contact 720 through conductive surface 716.

Figure 8:
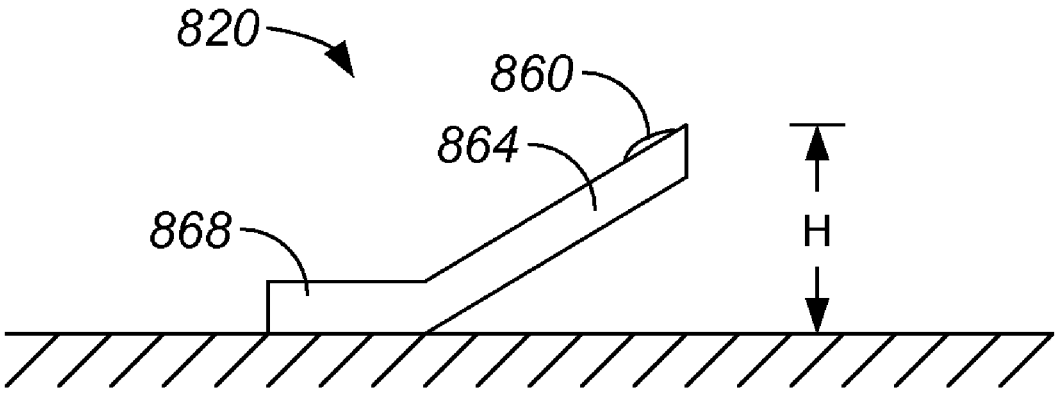
FIG. 8 is a diagrammatic representation of a contact in accordance with an embodiment of the present invention.

In one embodiment, contacts that are used in a multi-part switch arrangement are cantilever-type contacts. That is, contacts include a cantilever beam onto which a compressive force may be applied. A contact may be a stamped contact with a "dimple" feature arranged to substantially evenly distribute a contact force or pressure applied to the contact. With reference to FIG. 8, one embodiment of a contact will be described in accordance with an embodiment of the present invention. A contact 820 includes a cantilever portion 864 and a coupling end 868. Coupling end 868 is arranged to be mounted on to a circuit board or similar component, and may be integrally formed with cantilever portion 864, e.g., using a stamping process. A dimple feature 860 is arranged near a contact end of cantilever portion 864.

The dimensions of contact 820 may vary widely depending upon the requirements of a multi-part switch that includes contact 820. By way if example, if the available height for an assembly in which contact 820 is to be incorporated is relatively small, contact 820 may have a height H, as measured from a bottom of contact 820 to a top of contact 820, that is relatively small. Generally, a height H of contact 820 may be as small as approximately 0.03 inches. In one embodiment, a height H may be in the range of between approximately 0.03 inches and approximately 0.125 inches. It should be appreciated, however, that the height H may be widely varied. Often, as the height H increases, the overall dimensions of contact 820 may increase.

Although only a few embodiments of the present invention have been described, it should be understood that the present invention may be embodied in many other specific forms without departing from the spirit or the scope of the present invention. By way of example, the configuration of a contact may vary. That is, a contact is not limited to having a cantilever arrangement. Further, if a contact has a cantilever arrangement, the overall shape of the cantilever arrangement may vary widely, and the proportion of the contact that is formed by the cantilever arrangement may vary. For instance, the cantilever arrangement may form a significant proportion of the contact.

The amount of contact force, e.g., compression force, that is applied to contacts by a cover in order to effectively engage a multi-part switch in a compressed state may vary. The amount of contact force applied by a cover on contacts of a multi-part switch may vary, for instance, based upon factors that may include, but are not limited to including, the power required in a system that utilizes the multi-part switch, the conductivity of the contacts, and the nature of a signal that may be passed from one contact to the other.

Contact force may be applied to contacts by a cover using a variety of different mechanisms. For instance, contact force may be applied by effectively securing the cover to a circuit board on which the contacts are mounted. In one embodiment, the cover may be screwed into a chassis that supports the circuit board. Alternatively, substantially any mechanism may be used to enable a cover to apply a compressive force against contacts. Such a mechanism may include both a source of compressive force, and elements which prevent too much force from being applied to contacts, e.g., a mechanical stop that is arranged to engage a cover to prevent the cover from causing too much deflection in the contacts. A mechanical stop may also be arranged to prevent the cover from making contact with the contacts when contact is not desired.

In general, a multi-part switch that has a relatively low profile may be used in a variety of different applications. For instance, a multi-part switch may be used on backplanes and midplanes of a computing arrangement or routing device to enable the insertion and removal of blades to be detected. A multi-part switch may also be used to detect the insertion of a daughter card onto a motherboard when contacts which are coupled to the motherboard are effectively engaged by a conductive plane coupled to the daughter card. Additionally, a multi-part switch may be used to detect the removal of a cover from a device, as for example when a conductive plate attached to the cover breaks contact with contacts of the device, and to detect the opening or closing of a door.

Within an assembly that includes a circuit board and more than one multi-part switch, a single cover has been described as being used to depress all of the multi-part switches. It should be appreciated, however, that each multi-part switch may have a separate cover such that each multi-part switch may be substantially independently depressed. Further, a single cover may be arranged to depress multi-part switches with contacts of different heights. By way of example, a first pair of contacts may include contacts of a first height, while a second pair of contacts may include contacts of a second height. A single cover that is arranged to depress or deflect both pairs of contacts may be formed such that the conductive surface arranged to contact the first pair of contacts is at a different height than the conductive surface arranged to contact the second pair of contacts. In other words, the single cover may be arranged or machined to substantially simultaneously apply a compressive force to contacts of different heights.

The steps associated with the methods of the present invention may vary widely. Steps may be added, removed, altered, combined, and reordered without departing from the spirit or the scope of the present invention. Therefore, the present examples are to be considered as illustrative and not restrictive, and the invention is not to be limited to the details given herein, but may be modified within the scope of the appended claims.

What is claimed is:

1. An apparatus comprising:

a printed circuit board, the printed circuit board including at least a first trace and a second trace, the printed circuit board further including at least one electrical component;

a first contact, the first contact including a first cantilevered portion, wherein the first contact is mounted on the printed circuit board such that the first contact is communicably coupled to the first trace;

a second contact, the second contact including a second cantilevered portion, the second contact being mounted on the printed circuit board such that the second contact is communicably coupled to the second trace, wherein the at least one electrical component is located on the printed circuit board between the first contact and the second contact; and a cover, the cover including a conductive area, the conductive area being arranged to contact the first cantilevered portion and the second cantilevered portion to allow a signal to flow from the first contact to the second contact through the conductive area, wherein the cover is arranged to cover the at least one electrical component while contacting the first cantilevered portion and the second cantilevered portion.

2. The apparatus of claim 1 wherein the cover is arranged to apply a compressive force to the first cantilevered portion and the second cantilevered portion, the compressive force being arranged to cause the first cantilevered portion and the second cantilevered portion to deflect.

3. The apparatus of claim 1 wherein the printed circuit board has a width and a length, and wherein the cover is arranged to span the width and the length of the printed circuit board.

4. The apparatus of claim 1 wherein the cover is coupled to a grounded surface.

5. The apparatus of claim 1 further including:

a fastening arrangement, the fastening arrangement being arranged to secure the cover over the printed circuit board to cause the conductive area to contact the first cantilevered portion and the second cantilevered portion, wherein the fastening arrangement is further arranged to cause the cover to apply a compressive force to the first cantilevered portion and the second cantilevered portion.

* * * * *